US011114032B2

(12) United States Patent
Bian

(10) Patent No.: US 11,114,032 B2
(45) Date of Patent: Sep. 7, 2021

(54) DISPLAY STRUCTURE, DISPLAY PANEL AND DISPLAY DEVICE

(71) Applicant: Beijing Xiaomi Mobile Software Co., Ltd., Beijing (CN)

(72) Inventor: Qingfang Bian, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 16/554,311

(22) Filed: Aug. 28, 2019

(65) Prior Publication Data

US 2020/0105187 A1 Apr. 2, 2020

(30) Foreign Application Priority Data

Sep. 28, 2018 (CN) ..... 201811143397.4

(51) Int. Cl.
*G09G 3/325* (2016.01)

(52) U.S. Cl.
CPC ..... *G09G 3/325* (2013.01); *G09G 2300/0439* (2013.01); *G09G 2310/0264* (2013.01)

(58) Field of Classification Search
None
See application file for complete search history.

(56) References Cited

U.S. PATENT DOCUMENTS 8,289,303 B2 10/2012 Kim
2004/0233140 A1 11/2004 Jo
2008/0165267 A1* 7/2008 Cok ..... H04N 7/144 348/333.01
2016/0013252 A1 1/2016 Wang
2016/0293679 A1* 10/2016 Xu ..... G09G 3/3225
2016/0358543 A1 12/2016 Rappoport et al.
2017/0294155 A1* 10/2017 Kim ..... G09G 3/3225
2018/0240856 A1* 8/2018 Kim ..... H01L 27/3265

FOREIGN PATENT DOCUMENTS

CN 106921767 A 7/2017
CN 107610635 A 1/2018
CN 207264695 U 4/2018
(Continued)

OTHER PUBLICATIONS

First Office of Korean Application No. 10-2019-7017293 dated Jun. 4, 2020.

(Continued)

*Primary Examiner* — Stephen T. Reed
(74) *Attorney, Agent, or Firm* — Finnegan, Henderson, Farabow, Garrett & Dunner, L.L.P.

(57) ABSTRACT

The present disclosure relates to a display structure, a display panel, and a display device. The display structure includes: a plurality of pixels and a plurality of first driving circuits. The plurality of pixels are provided in a first area of the display structure. The plurality of pixels are arranged based on a preset pattern. An area of the preset pattern is less than that of the first area. Each pixel includes sub-pixels of a plurality of colors, and each sub-pixel includes an organic light emitting diode. The plurality of first driving circuits are provided in a second area outside the first area, connected to the organic light emitting diodes, and configured to drive the organic light emitting diodes to emit light.

20 Claims, 7 Drawing Sheets

(56) References Cited

FOREIGN PATENT DOCUMENTS

| | | | |
|---|---|---|---|
| CN | 108520888 | A | 9/2018 |
| EP | 1 146 501 | A1 | 10/2001 |
| JP | H 10229296 | | 8/1998 |
| JP | 2000-98932 | A | 4/2000 |
| JP | 2001183998 | A | 7/2001 |
| JP | 2010-509804 | A | 3/2010 |
| JP | 2017-37317 | A | 2/2017 |

OTHER PUBLICATIONS

First Office of Russian Application No. 2019126578 dated Apr. 27, 2020.
Extended European Search Report for Application No. 19194178.0, dated Feb. 7, 2020.
International Search Report of PCT Application No. PCT/CN2018/121417 from China's State Intellectual Property Office (ISA/CN) Beijing, China, dated Jun. 27, 2019.
Notice of Reasons for Refusal dated Dec. 22, 2020, from the Japanese Patent Office, in counterpart Japanese Application No. 2019-529566.

* cited by examiner

DISPLAY STRUCTURE, DISPLAY PANEL AND DISPLAY DEVICE

CROSS-REFERENCE TO RELATED APPLICATION

This application is based upon and claims priority to Chinese Patent Application No. 201811143397.4, filed on Sep. 28, 2018, the entire content of which is incorporated herein by reference.

FIELD

The present disclosure relates to a field of display technologies, and more particularly to a display structure, a display panel, and a display device.

BACKGROUND

A mobile terminal is integrated with more and more functions to improve its intelligence. A photographing function is one of them. In order to implement the photographing function, an image collection device needs to be integrated in the mobile terminal. Also, a hole needs to be opened in the front of the mobile terminal for installing the image collection device to make sure that e image collection device can collect an image at the front of the mobile terminal, which not only influences beauty of the mobile terminal, but also reduces an area ratio of a display area in the front of the mobile terminal.

SUMMARY

The present disclosure provides a display structure, a display panel, and a display device.

According to a first aspect of embodiments of the present disclosure, a display structure is provided. The display structure includes: a plurality of pixels and a plurality of first driving circuits. The plurality of pixels are provided in a first area of the display structure. The plurality of pixels are arranged based on a preset pattern. An area of the preset pattern is less than that of the first area. Each pixel includes sub-pixels of a plurality of colors, and each sub-pixel includes an organic light emitting diode. The plurality of first driving circuits are provided in a second area outside the first area, connected to the organic light emitting diodes, and configured to drive the organic light emitting diodes to emit light.

According to a second aspect of embodiments of the present disclosure, a display panel is provided. The display panel includes the display structure according to the first aspect, and further includes an effective emitting area. The effective emitting area is provided with a plurality of effective emitting pixels and a plurality of second driving circuits. Each effective emitting pixel includes a plurality of sub-pixels, and the sub-pixels in the effective emitting area are provided to correspond to the second driving circuits one by one.

According to a third aspect of embodiments of the present disclosure, a display device is provided. The display device includes the display panel according to the second aspect, and further includes an image collection device. The image collection device is provided in the first area, and located on a side of the display structure away from a light emitting direction.

It should be understood that, the general description above and the detailed description below are only exemplary and explanatory, and are not intended to limit the present disclosure.

BRIEF DESCRIPTION OF THE DRAWINGS

The accompanying drawings, which are incorporated into and constitute a part of the specification, illustrate embodiments of the present disclosure, and together with the description, serve to explain principles of the present disclosure.

DETAILED DESCRIPTION

Illustration will be made in detail here to exemplary embodiments. Examples of embodiments are illustrated in the accompanying drawings. When description relates to the accompanying drawings, the same numbers in different accompanying drawings represent the same or similar elements, unless otherwise specified, and the implementations described below in the exemplary embodiments do not represent all implementations consistent with the present disclosure. Instead, they are merely examples of devices and methods described in the accompanying claims and consistent with aspects of the present disclosure.

Figure 1:
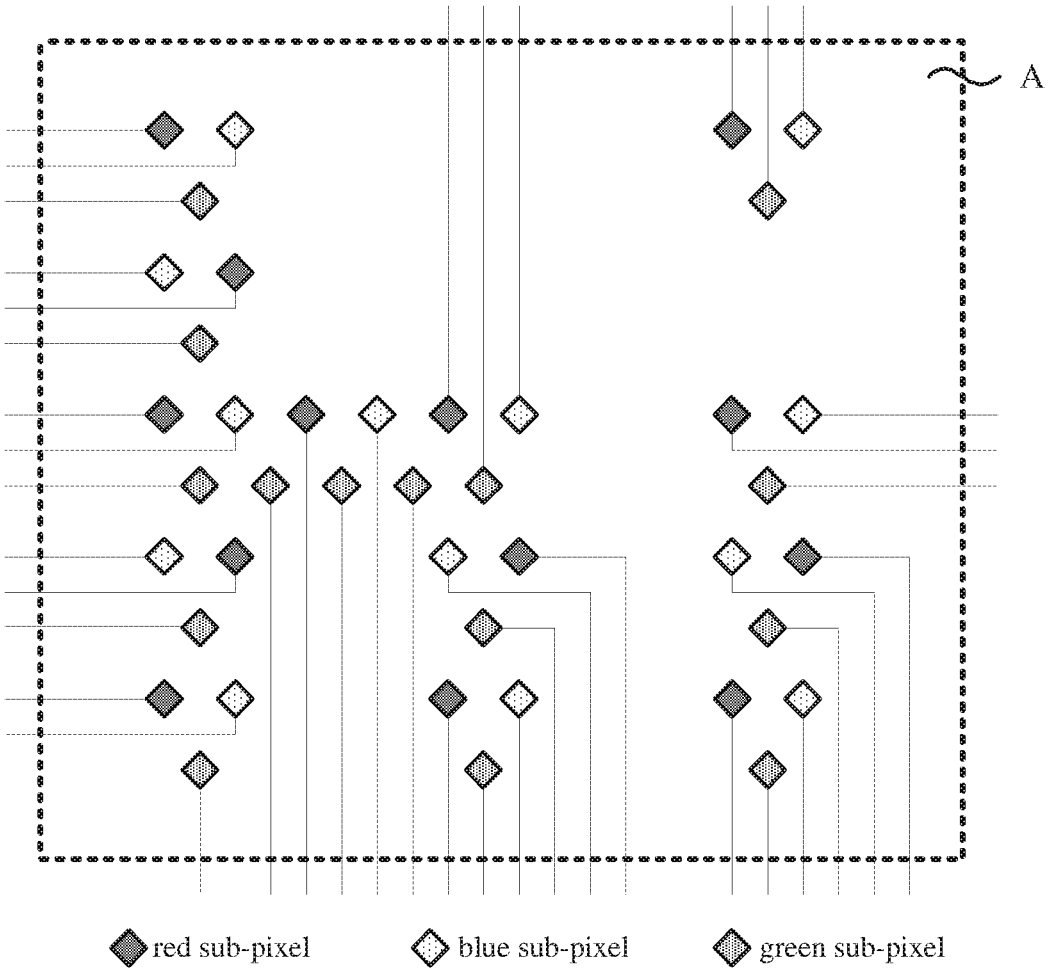
FIG. 1 is a schematic diagram illustrating a display structure according to an embodiment of the present disclosure.
Figure 2:
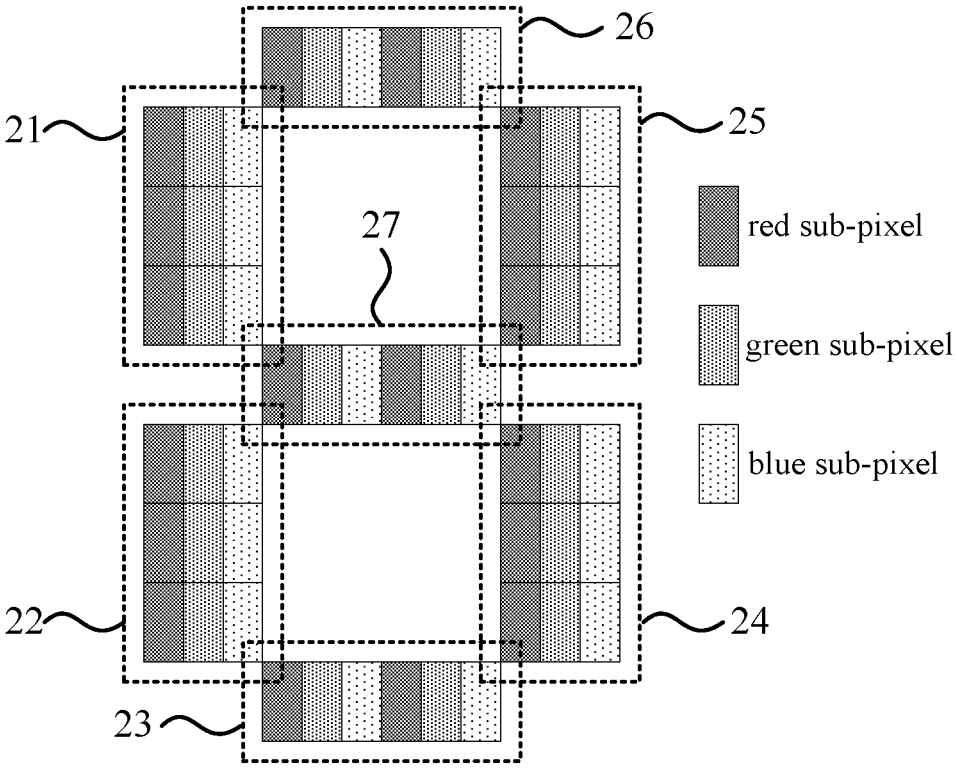
FIG. 2 is a schematic diagram illustrating a display structure according to another embodiment of the present disclosure.
Figure 3:
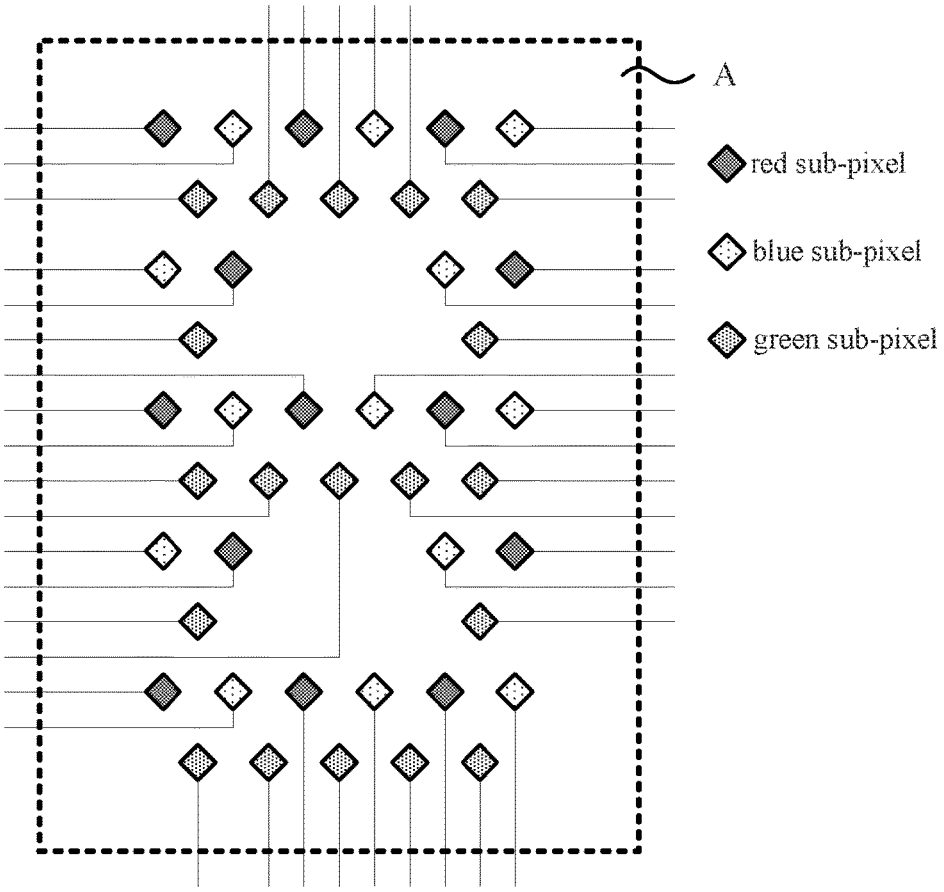
FIG. 3 is a schematic diagram illustrating a display structure according to still another embodiment of the present disclosure.

FIG. 1 is a schematic diagram illustrating a display structure according to an embodiment of the present disclosure. FIG. 2 is a schematic diagram illustrating a display structure according to another embodiment of the present disclosure. FIG. 3 is a schematic diagram illustrating a display structure according to still another embodiment of the present disclosure. As illustrated in FIG. 1, FIG. 2 and FIG. 3, the display structure includes: a plurality of pixels and a plurality of first driving circuits.

The plurality of pixels are provided in a first area A of the display structure. The plurality of pixels are arranged based on a preset pattern. An area of the preset pattern is less than that of the first area A. Each pixel includes sub-pixels of a plurality of colors, and each sub-pixel includes an organic light emitting diode.

The plurality of first driving circuits are provided in a second area outside the first area A, and are connected to all the organic light emitting diodes. The plurality of first driving circuits are configured to drive all the organic light emitting diodes to emit light.

In an embodiment, each pixel includes at least a red sub-pixel, a green sub-pixel and a blue sub-pixel. An arrangement way of the red sub-pixels, the green sub-pixels and the blue sub-pixels is illustrated in FIG. 1, which shows arrangement similar to crystals. Each pixel includes a red sub-pixel, a green sub-pixel and two blue sub-pixels. The arrangement way of the sub-pixels may further be provided based on the need. For example, as illustrated in FIG. 2, the sub-pixels may be arranged in a matrix form, in which, each pixel includes a red sub-pixel, a green sub-pixel and a blue sub-pixel.

In an embodiment, the preset pattern may be provided based on the need. For example, as illustrated in FIG. 1, the preset pattern is characters "hi", or as illustrated in FIG. 2, the preset pattern is a character "8" structured by seven display segments 21-27. As illustrated in FIG. 3, the sub-pixels included an each pixel in the display segment may be arranged similar to crystals. It is understood that the preset pattern is not limited to the patterns illustrated in FIG. 1, FIG. 2 or FIG. 3, and may be provided based on the need. For example, in addition to providing the preset pattern, elements structuring the pattern may further be provided, for example, a number of the display segments provided may be other numbers in addition to seven.

Since the area of the preset pattern is less than that of the first area, i.e., the pixels do not fully fill the first area. Compared to the situation where the pixels fully fill the first area, since there are fewer pixels in this embodiment, a number of first driving circuits configured to drive the organic light emitting diodes may be less, thereby to facilitate providing the first driving circuits in the second area (not shown) outside the first area.

For example, the second area may be provided along edges of the first area, or the second area may be provided at one side of the first area, which may be provided based on the preset pattern.

According to embodiments of the present disclosure, since the first driving circuit contains a shading structure such as the transistor, the capacitor, but the organic light emitting diode is transparent, the sub-pixels are provided in the first area, and the first driving circuits are provided in the second area outside the first area, such that the display structure at the first area is close to transparency; and the plurality of pixels in the first area are arranged based on the preset pattern, such that the display structure at the first area may has a certain display function, for example, the display structure may display the preset pattern.

Based on the above, in a display device containing the display structure, if it needs to provide an image collection device in the display device, the image collection device may be provided under the first area of the display structure. Since the first area is close to transparency, it can be ensured that the image collection device is not shaded, and the first area still has a certain display effect and also belongs to the part of the display area, which is beneficial to improve a ratio of the display area in the front of the display device, and makes the display device look beautiful on the whole.

In an embodiment, each first driving circuit is connected to one of the organic light emitting diodes correspondingly.

In an embodiment, one first driving circuit may drive one organic light emitting diode to emit light. Based on this, different organic light emitting diodes may be controlled independently, to facilitate partly displaying the plurality of pixels based on displaying the preset pattern, such that richer patterns may be displayed.

In an embodiment, at least one first driving circuit is connected to multiple organic light emitting diodes correspondingly.

In an embodiment, the multiple organic light emitting diodes may be driven by one first driving circuit. Based on this, the multiple organic light emitting diodes may be connected to one first driving circuit by a wire, which may be beneficial to reduce a wiring layout design. Since the wire has influence on the transmittance of the display structure, the first area having higher transmittance may be further guaranteed.

Corresponding to the situation of embodiments illustrated in FIG. 2, the organic light emitting diodes in the pixels of one display segment may be driven by the first driving circuits, in which, the number of the first driving circuits corresponds to the number of the colors of the sub-pixels. For example, for one of the seven display segments, if the pixels contain sub-pixels of three colors that are red, green and blue, the display segment may be driven by three first driving circuits. Correspondingly, the seven display segments may be driven by twenty-one first driving circuits, such that the pixels in the display segments may be lighted up or extinguished simultaneously as a whole, which is beneficial to improve the sight effect.

In an embodiment, each pixel includes sub-pixels of n colors, and each sub-pixel includes the organic light emitting diode.

The plurality of first driving circuits include n first driving circuits, and the $i^{th}$ first driving circuit of the n first driving circuits is configured to drive the organic light emitting diode in each sub-pixel of the $i^{th}$ color to emit light, $1 \leq i \leq n$, i and n are integers, and $n>1$.

In an embodiment, on the basis that the first driving circuits are connected to the organic light emitting diodes by a one-to-more way, the organic light emitting diodes in the sub-pixels of the same color may be connected to one first driving circuit. Taking n=3 as an example, the three first driving circuits may achieve driving the organic light emitting diodes, such that the wiring layout design may be further reduced, which is beneficial to improve the transmittance of the first area.

In an embodiment, the first driving circuit includes a driving transistor, and the organic light emitting diode includes a first electrode, a second electrode, and an organic light emitting layer provided between the first electrode and the second electrode.

The driving transistor in the $i^{th}$ first driving circuit is connected to the first electrode in each sub-pixel of the $i^{th}$ color.

In an embodiment, the structure of the organic light emitting diode may provide an organic light emitting layer between the first electrode and the second electrode, in which the first electrode is an anode and the second electrode is a cathode, or the first electrode is a cathode and the second electrode is an anode. The following mainly exemplifies the situation that the first electrode is the anode and the second electrode is the cathode.

For different organic light emitting diodes, the first electrodes are provided on the same side of the organic light emitting diodes. Therefore, driving the plurality of sup-pixels is implemented by the driving transistor connecting to the plurality of first electrodes, the structure of which is simple compared to the driving transistor connecting the first electrodes of some sub-pixels and the second electrodes of some other sub-pixels.

Figure 4:
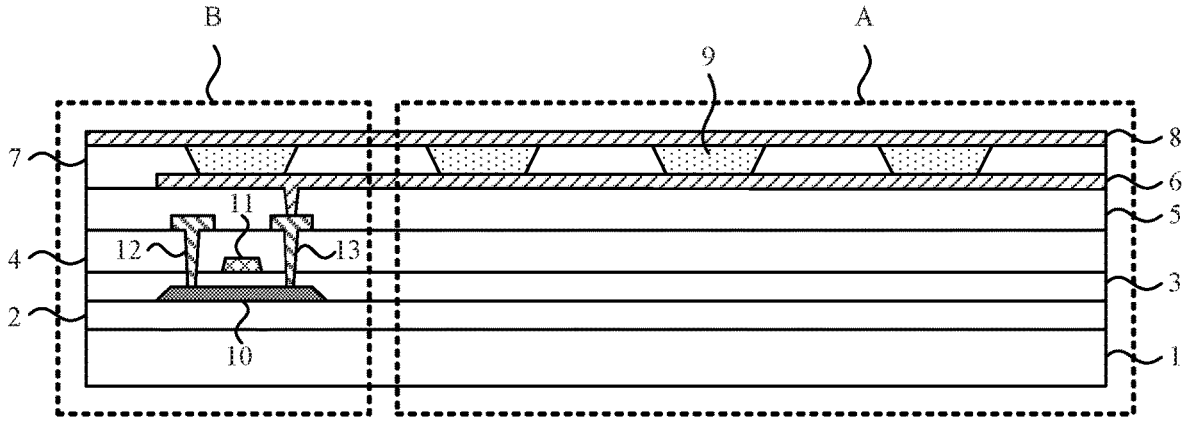
FIG. 4 is a schematic diagram illustrating a cross section of a display structure according to an embodiment of the present disclosure.
Figure 5:
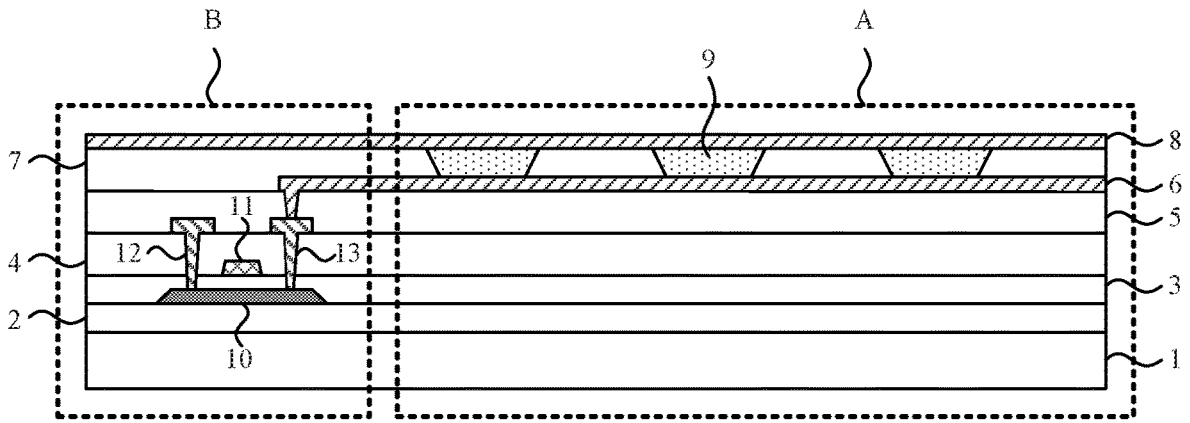
FIG. 5 is a schematic diagram illustrating a cross section of a display structure according to another embodiment of the present disclosure.

FIG. 4 is a schematic diagram illustrating a cross section of a display structure according to an embodiment of the present disclosure. FIG. 5 is a schematic diagram illustrating a cross section of a display structure according to another embodiment of the present disclosure. As illustrated in FIG. 4 and FIG. 5, the first electrodes 6 of the neighboring sub-pixels of the same color are connected.

In an embodiment, as illustrated in FIG. 4, the display structure may include, from bottom to top: a substrate 1, a buffer layer 2, a gate insulator layer 3, an interlayer dielectric layer 4, a planar layer 5, a first electrode 6, a pixel define layer 7, and a second electrode 8. A driving transistor includes an active layer 10, a gate 11, a source 12 and a drain 13. An organic material layer 9 is provided between the first electrode 6 and the second electrode 8.

Each organic material layer 9 corresponds to a sub-pixel, and the first electrodes 6 of the plurality of sub-pixels of the same color are connected. According to this, when the first electrodes 6 are formed, the plurality of sub-pixels of the same color may be connected by connecting the first electrodes 6, and the structure connecting the first electrodes 6 of the sub-pixels may be formed by the driving transistor connecting to the first electrode 6 of any sub-pixel, which is beneficial to simplify the connecting structure between the driving transistor and the first electrodes 6.

The driving transistor may be connected to the plurality of sub-pixels of the same color based on other ways. For example, in the situation that first electrodes of the plurality of sub-pixels of the same color are not connected, a hole may be provided in the position corresponding to the first electrode of each sub-pixel, and then the drain of the driving transistor is extended to each hole, to implement electric connection with the first electrode of each hole.

It should be noted that, in the embodiment illustrated in FIG. 4, the organic material layer 9 is provided above the driving transistor. That is, the second area B where the driving transistor is located may further emit light. In the embodiment illustrated in FIG. 5, an organic material layer is not be provided above the driving transistor based on the need. As illustrated in FIG. 5, the second area B where the first driving transistor is located does not emit light.

In an embodiment, the display structure further includes a control unit.

The control unit is connected to the plurality of first driving circuits. The control unit is configured to control the plurality of first driving circuits to drive one or more organic light emitting diodes at one or more pixels of a preset position in the preset pattern to emit light.

In an embodiment, the control unit may enable the first driving circuits to drive the one or more organic light emitting diodes at the one or more pixels of the preset position in the preset pattern to emit light by controlling the first driving circuits. According to this, the plurality of pixels arranged in the preset pattern may emit light at the preset position in the preset pattern. The preset position may be provided in advance before controlling the first driving circuits, such that the one or more pixels may be controlled to emit light based on the preset position provided in advance, to facilitate displaying the content to satisfy the need.

For example, in embodiments illustrated in FIG. 1, the organic light emitting diodes at the pixels of the character "h" in the preset pattern may be controlled to emit light, such that the displayed image is "h", and is not "hi".

In an embodiment, the preset pattern includes a plurality of display segments, and each display segment includes a plurality of adjacent pixels.

In an embodiment, the plurality of adjacent pixels may form the display segment, and then the plurality of display segments form the preset pattern. According to this, the control unit may control one or more display segments which are located at the preset position to light, such that the one or more display segments may form the content needed.

For example, in the embodiment illustrated in FIG. 2, the pattern displayed equivalents to seven display segments, which may display one of 0-9 numbers and a plurality of English characters by controlling one of the display segments to emit or extinguish light. For example, the organic light emitting diodes at the pixels of the two vertical display segments 24 and 25 in the right of the seven display segments may be controlled to emit light, such that the pattern displayed is "1" and is not "8". And the pattern may include a plurality of groups of the above seven display segments. For example, a pattern includes two groups of the above seven display segments, and then one of 0-99 numbers may be displayed.

In an embodiment, the control unit is configured to control one or more organic light emitting diodes in one or more pixels locating in the same display segment to emit or extinguish light simultaneously.

In the embodiment, the control unit may control the one or more organic light emitting diodes in the one or more pixels locating in the same display segment to emit or extinguish light simultaneously. According to this, it may ensure that, when a certain display segment is controlled to emit or extinguish light, this display segment may be emitted or extinguished as a whole, and may not be emitted or extinguished a pixel by a pixel, which is beneficial to ensure a sight effect that the one or more pixels in the display segment are as a whole.

In an embodiment, the one or more pixels in the preset position are part of pixels in the preset pattern, or all pixels in the preset pattern.

In an embodiment, the pixels of the preset position, which are controlled to emit light by the control unit, may be part of pixels in the preset pattern, and may further be all the pixels in the preset pattern. That is, part of areas in the preset pattern may be controlled to light, or all the areas in the preset pattern may be controlled to light.

Figure 6:
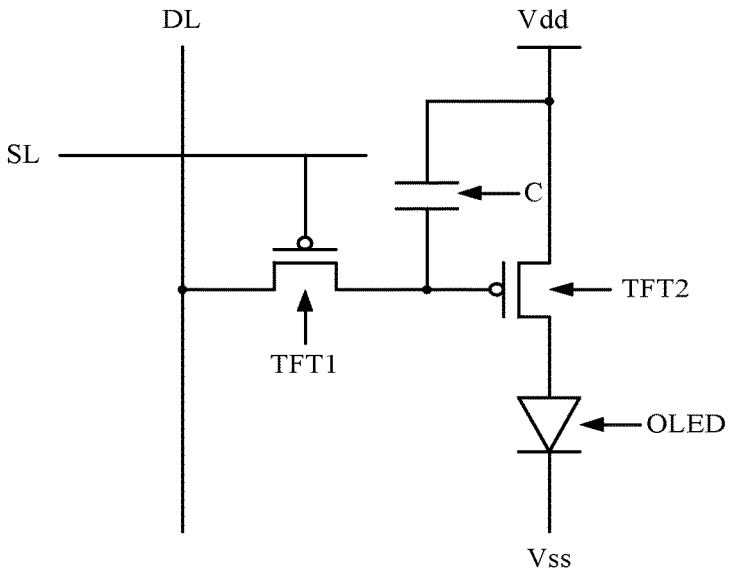
FIG. 6 is a schematic diagram illustrating a driving circuit according to embodiments of the present disclosure.

FIG. 6 is a schematic diagram illustrating a driving circuit according to embodiments of the present disclosure. As illustrated in FIG. 6, the driving circuit includes: a switching transistor TFT1, a driving transistor TFT2 and a capacitance C.

A first terminal of the switching transistor TFT1 is connected to a scan line SL, and a second terminal of the switching transistor TFT1 is connected to a data line DL.

A first terminal of the driving transistor TFT2 is connected to a third terminal of the switching transistor TFT1, a second terminal of the driving transistor TFT2 is connected to a preset voltage terminal Vdd, and a third terminal of the driving transistor TFT2 is connected to an organic light emitting diode OLED.

A first terminal of the capacitance C is connected to the first terminal of the driving transistor TFT2, and a second terminal of the capacitance C is connected to the second terminal of the driving transistor TFT2.

In an embodiment, the above first terminal may be the gate, the second terminal may be the source, and the third terminal may be the drain. The scan line SL inputs a signal to the gate of the switching transistor TFT1, such that the switching transistor TFT1 is turned on. A signal in the data line DL is transmitted from the source of the switching transistor TFT1 to the drain of the switching transistor TFT1, and is applied to the gate of the driving transistor TFT2, such that the driving transistor TFT2 is turned on. A signal of the preset voltage terminal Vdd passes through the driving transistor TFT2 to generate a current signal, and the current signal is inputted to the organic light emitting diode OLED, such that the organic light emitting diode OLED emits light.

It should be noted that, the structure of the driving circuit is not limited to the situation in embodiments illustrated in FIG. 6. For example, the structure may further adopt structures or processing such as 6T1C, 7T1C or NMOS (N-Metal-Oxide-Semiconductor), CMOS (Complementary-Metal-Oxide-Semiconductor).

Figure 7:
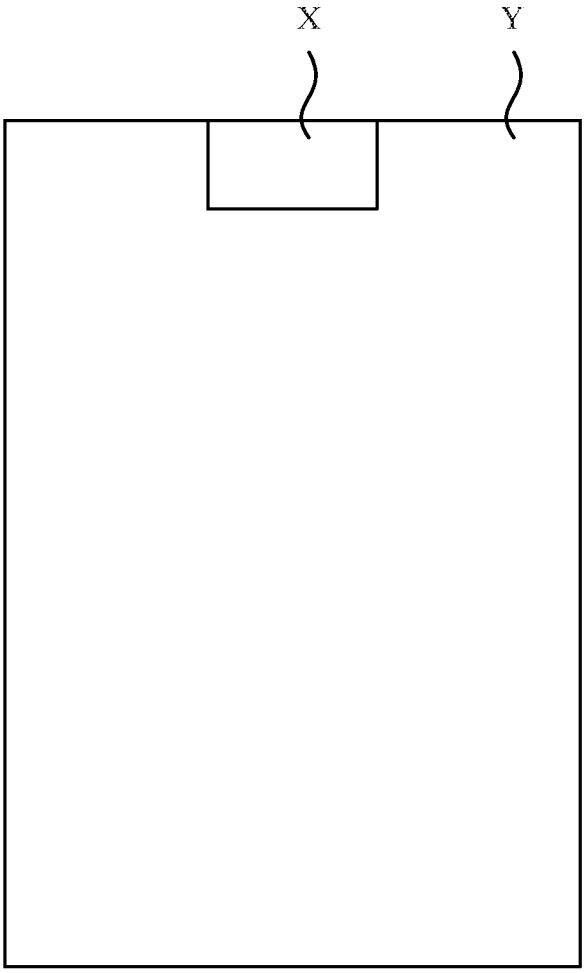
FIG. 7 is a schematic diagram illustrating a display panel according to embodiments of the present disclosure.

FIG. 7 is a schematic diagram illustrating a display panel according to embodiments of the present disclosure. As illustrated in FIG. 7, the display panel includes a display structure X according to any of the above embodiments, and an effective emitting area Y.

The effective emitting area Y is provided with a plurality of effective emitting pixels and a plurality of second driving circuits. Each effective emitting pixel includes a plurality of sub-pixels, and the sub-pixels in the effective emitting area Y are provided to correspond to the second driving circuits one by one.

In an embodiment, since sub-pixels correspond to second driving circuits one by one in the effective emitting area of the display panel, for example, the driving transistor may be provided under the organic emit layer of the sub-pixel, such that each sub-pixel may be controlled independently, to implement to display the pattern in the effective emitting area.

In this situation, if it needs to provide an image collection device under the display panel, the image collection device may be provided under the first area of the display structure. And since the first area of the display structure is close to transparency, and has a certain display effect, both the effective emitting area and the first area of the display structure may be taken as the display area, such that the area provided with the image collection device may further be taken as the display area, which is beneficial to improve a ratio of a display area in the front of the display device, and enables the display device more beautiful on the whole.

It should be noted that, in the embodiment illustrated in FIG. 4, the organic material layer 9 is provided above the driving transistor. That is, the second area B where the first driving circuit is located may further emit light. In this situation, the driving transistors in the display structure and the driving transistors of the second driving circuits in the effective emitting area may be reused.

In the embodiment illustrated in FIG. 5, an organic material layer is not provided above the driving transistor, and then the driving transistor in the display structure may be provided in a frame area of the display panel, to avoid the driving transistor affecting the transmittance.

In an embodiment, on the basis of the embodiments illustrated in FIG. 7, there may be following embodiments.

In an embodiment, each first driving circuit is connected to one of the organic light emitting diodes correspondingly.

In an embodiment, at least one first driving circuit is connected to multiple organic light emitting diodes correspondingly.

In an embodiment, each pixel includes sub-pixels of n colors, and each sub-pixel includes the organic light emitting diode.

The plurality of first driving circuits include n first driving circuits, and the $i^{th}$ first driving circuit of the n first driving circuits is configured to drive the organic light emitting diode in each sub-pixel of the $i^{th}$ color to emit light, $1 \leq i \leq n$, i and n are integers, and $n>1$.

In an embodiment, the first driving circuit includes a driving transistor, and the organic light emitting diode includes a first electrode, a second electrode, and an organic light emitting layer provided between the first electrode and the second electrode.

The driving transistor in the $i^{th}$ first driving circuit is connected to the first electrode in each sub-pixel of the $i^{th}$ color.

In an embodiment, the first electrodes in neighboring sub-pixels of the same color are connected.

In an embodiment, the display structure further includes a control unit.

The control unit is connected to the plurality of first driving circuits, and configured to control the plurality of first driving circuits to drive one or more organic light emitting diodes at one or more pixels of a preset position in the preset pattern to emit light.

In an embodiment, the display panel further includes: a gate driving circuit and a data signal circuit.

The gate driving circuit is configured to input gate driving signals to driving circuits.

The data signal circuit is configured to input data signals to driving circuits.

The driving circuits may include the first driving circuits in the display structure, and further include the second driving circuits in the effective emitting area.

In an embodiment, the gate driving circuit may input the gate driving signal to the driving circuit through the scan line. For n first driving circuits in the above display structure, the gate driving signal may be inputted to the n first driving circuits through one scan line, or the gate driving signal may be inputted to the n first driving circuits one by one through n scan lines. In addition, for x first driving circuits in the n first driving circuits, the gate driving signal may be inputted by one scan line, and for n−x first driving circuits in the n first driving circuits, the gate driving signal may be inputted to the n−x first driving circuits by n−x scan lines one by one, in which x is a positive integer less than n.

For the plurality of second driving circuits in the effective emit area of the above display panel, the gate driving signal may further be inputted by the scan line, and the scan lines for inputting the gate driving signal to the second driving circuits in the effective emit area of the display panel may be reused to input the gate driving signal to the first circuits in the display structure described above.

The scan lines for inputting the gate driving signal to the second driving circuits in the effective emit area of the display panel may be different from the scan lines for inputting the gate driving signal to the first driving circuits in the above display structure. For example, the gate driving signal is input to the first driving circuits in the above display structure by one scan line, and the gate driving signal is input to the second driving circuits in the effective emit area of the display panel by m scan lines. The scan line for inputting the gate driving signal to the first driving circuits in the display structure may be arranged anywhere in the m+1 scan lines, such as arranged as the first line or arranged as the $(m+1)^{th}$ line.

Figure 8:
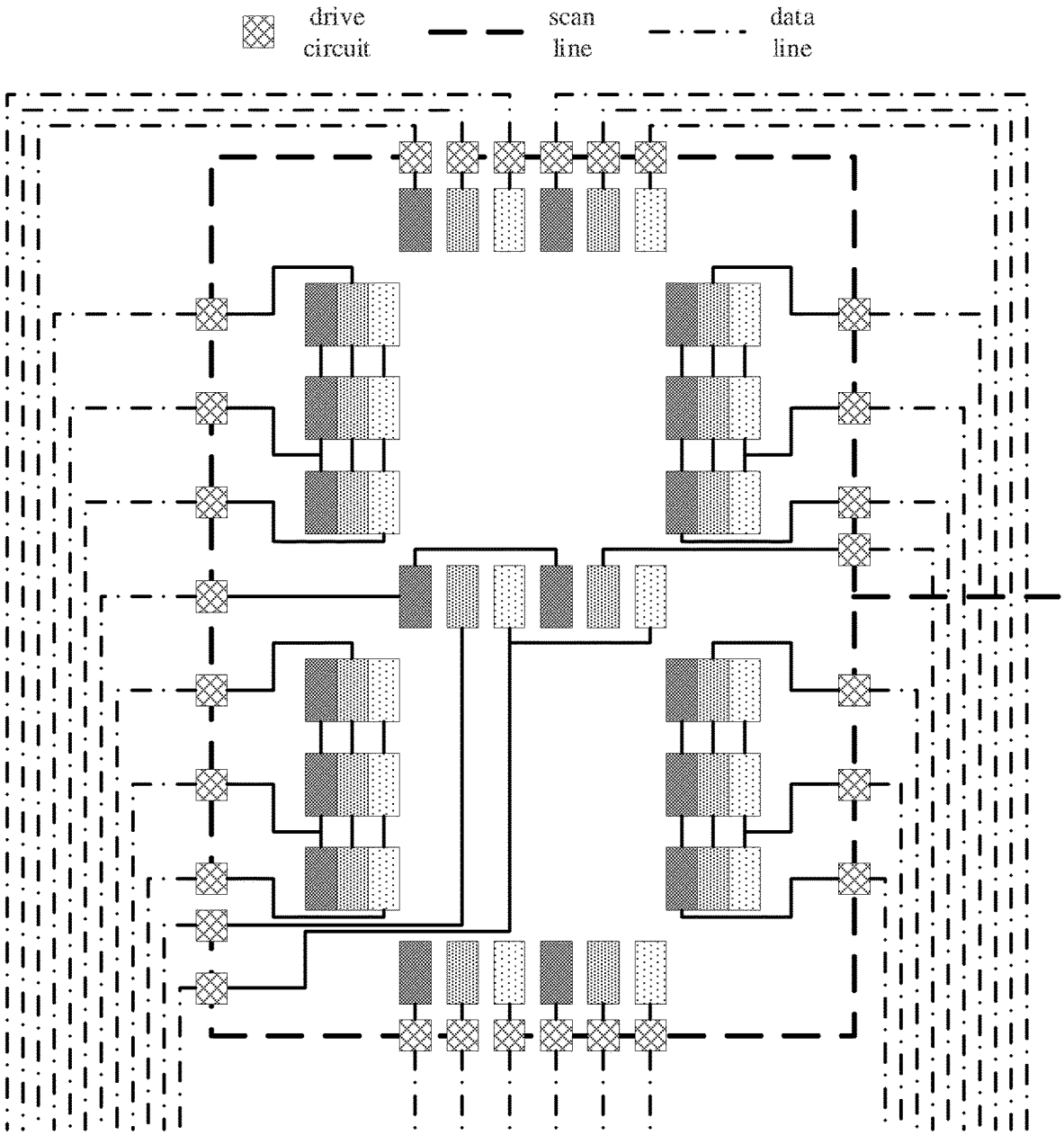
FIG. 8 is a schematic diagram illustrating a wiring of a display panel according to embodiments of the present disclosure.

FIG. 8 is a schematic diagram illustrating a wiring of a display panel according to embodiments of the present disclosure.

As illustrated in FIG. 8, on the basis of the embodiment illustrated in FIG. 2, at least one driving circuit is correspondingly connected to multiple organic light emitting diodes. For example, for part of display segments, the sub-pixels of the same color in each display segment may be connected to the same driving circuit, such as all the red sub-pixels in the display segment 21 may be connected to the same driving circuit, all the green sub-pixels may be connected to the same driving circuit, and all the blue sub-pixels may be connected to the same driving circuit.

For another part of the display segments, each driving circuit may be correspondingly connected to one of the organic light emitting diodes. For example, the sub-pixels in the display segment 23 and the driving circuits are in a one-to-one correspondence relationship.

Further, as illustrated in FIG. 8, all the driving circuits may be connected to GOA (Gate IC On Array) of the display panel by one scan line SL, and each driving circuit may be respectively connected to the data signal circuit of the display panel by a data line SL.

In addition, it should be noted that, for the first driving circuits in the display structure and the second driving circuits in the effective emit area, the gate driving signal may be inputted through the same gate driving circuit, or may be inputted through different gate driving circuits; the data signal may be inputted through the same data signal circuit, or may be inputted through different data signal circuits.

In an embodiment, the display panel further includes an array substrate.

The gate driving circuit is provided in the array substrate.

In an embodiment, the gate driving circuit (Gate IC) may be provided in the array substrate, to form a GOA structure.

Embodiments of the present disclosure further provide a display device, including the display panel according to any of the above embodiments, and an image collection device.

The image collection device is provided in the first area, and located on a side of the display structure away from a light emitting direction.

In an embodiment, the image collection device may be provided under the display panel. For example, the image collection device may be provided at the first area of the display area, and be located on the side of the display structure away from the light emitting direction. Since the first area is close to transparency, and has the display function to some extent, both the effective emit area and the first area of the display structure may be used as the display area, such that the area provided with the image collection device may further be taken as the display area, which is beneficial to improve a ratio of a display area in the front of the display device, and enables the display device more beautiful on the whole.

In an embodiment, the display device further includes a sensor.

The sensor is provided in the first area, and located on a side of the display structure away from a light emitting direction.

In an embodiment, if it needs to provide a sensor in the display device, the sensor may be provided in the first area of the display area, and located on the side of the display structure away from the light emitting direction, such that the area provided with the sensor may further be the display area, which is beneficial to improve a ratio of a display area in the front of the display device, and makes the display device look beautiful on the whole. The sensor may include a distance sensor, an ambient light sensor and the like.

It should be noted that, the above display device may be a mobile terminal, such as a phone, a table computer, an intelligent wearable device, or may further be other types of devices, such as a television and a computer screen.

Figure 9:
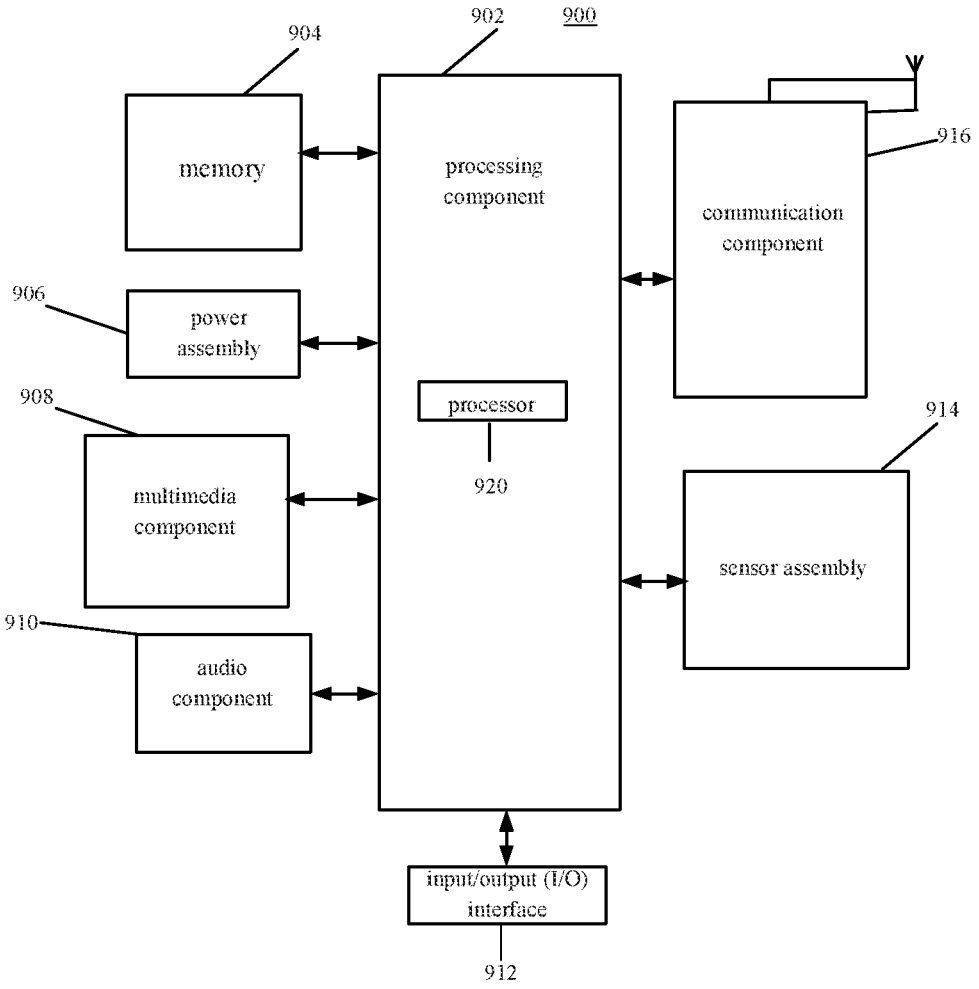
FIG. 9 is a block diagram illustrating a device for displaying according to embodiments of the present disclosure.

FIG. 9 is a block diagram illustrating a device 900 for displaying according to embodiments of the present disclosure. For example, the device 900 may be a mobile phone, a computer, a digital broadcast device, a messaging device, a game console, a tablet device, a medical device, a fitness device, a personal digital assistant, and the like.

As illustrated in FIG. 9, the device 900 may include one or more components as follows: a processor component 902, a memory 904, a power assembly 906, a multimedia component 908, an audio component 910, an input/output (I/O) interface 912, a sensor assembly 914, and a communication operation 916. The device 900 further includes a display panel as described in any of the embodiments.

The processing component 902 usually controls overall operation of the device 900, such as operations associated with display, telephone calls, data communications, camera operations, and recording operations. The processing component 902 may include one or more processors 920 to execute instructions, to complete all or part of the operations in the above described methods. In addition, the processing component 902 may include one or more modules which facilitate interaction between the processing component 902 and other components. For instance, the processing component 902 may include a multimedia module to facilitate interaction between the multimedia component 908 and the processing component 902.

The memory 904 is configured to store various types of data to support operations at the device 900. Examples of such data include instructions for any applications or methods operated on the device 900, contact data, phonebook data, messages, pictures, videos, etc. The memory 904 may be implemented using any type of volatile or non-volatile storage devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power assembly 906 provides power to various components of the device 900. The power assembly 906 may include a power management system, one or more power supplies, and other components related to generation, management, and distribution of power in the device 900.

The multimedia component 908 includes a screen that provides an output interface between the device 900 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a duration and a pressure associated with the touch or swipe action. In some embodiments, the multimedia component 908 includes a front camera and/or a rear camera. When the device 900 is in an operation mode, such as a photographing triode or a video mode, the front camera and/or the rear camera may receive external multimedia data. Each of the front and rear cameras may be a fixed optical lens system or have a focus and optical zoom capability.

The audio component 910 is configured to output and/or input audio signals. For example, the audio component 910 includes a microphone (MIC) configured to receive an external audio signal when the device 900 is in an operating mode, such as a call mode, a recording mode, and a speech recognition mode. The received audio signal may be further stored in the memory 904 or transmitted via the communication component 916. In some embodiments, the audio component 910 further includes a loudspeaker, which is configured to output the audio signals.

The I/O interface 912 provides an interface between the processing component 902 and a peripheral interface module, such as a keyboard, a click wheel, a button and the like. The buttons may include, but are not limited to, a home button, a volume button, a starting button, and a locking button.

The sensor assembly 914 includes one or more sensors for providing status assessments of various aspects of the device 900. For example, the sensor assembly 914 may detect an open/closed state of the device 900, relative positioning of the components, such as the display and the keypad of the device 900, a change in position of the device 900 or of a component of the device 900, presence or absence of user contact with that device 900, an orientation or an acceleration/deceleration of the device 900, and a change in temperature of the device 900. The sensor assembly 914 may include a proximity sensor configured to detect the presence of nearby objects without any physical contact. The sensor assembly 914 may also include a light sensor, such as a CMOS or CCD image sensor, for use in imaging applications. In some embodiments, the sensor assembly 914 may also include an accelerometer sensor, a gyroscope sensor, a magnetic sensor, a pressure sensor, or a temperature sensor.

The communication component 916 is configured to facilitate wired or wireless communication between the device 900 and other devices. The device 900 can access a wireless network based on a communication standard, such as Wi-Fi, 2 G, or 3 G, or a combination of them. In an exemplary embodiment, the communication component 916 receives a broadcast signal or broadcast related information from an external broadcast management system via a broadcast channel. In an exemplary embodiment, the communication component 916 further includes a near field communication (NFC) module to facilitate short-range communication. For example, the NFC module may be implemented based on a radio frequency identification (RFID) technology, an infrared data association (IrDA) technology, an ultra-wideband (UWB) technology, a Bluetooth (BT) technology, and other technologies.

In exemplary embodiments, the device 900 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the methods described above.

In exemplary embodiments, there is also provided a non-transitory computer readable storage medium including instructions, such as the memory 904 including instructions. The instructions can be executed by the processor 920 of the device 900 to perform the methods described above. For example, the non-transitory computer readable storage medium may be a ROM, a random access memory (RAM), a CD-ROM, a magnetic tape, a floppy disk, an optical data storage device, and the like.

The application is intended to cover any variations, uses or adaptations of the present disclosure. The variations, uses or adaptations follow general principles of the present disclosure and include common knowledge or conventional techniques in the field of the technology not disclosed by the present disclosure. The specification and embodiments are merely exemplary, and the true scope and spirit of this present disclosure is indicated by the claim below.

The present disclosure is not limited to the structure described above and illustrated in the accompanying drawings, and may be modified and altered without departing from the scope of the present disclosure. The scope of the present disclosure is limited only by the accompanying claims.

What is claimed is:

1. A display structure, comprising:

a plurality of pixels provided in a first area of the display structure, wherein the plurality of pixels are arranged based on a preset pattern, an area of the preset pattern is less than that of the first area, each pixel comprises sub-pixels of three different colors, and each sub-pixel comprises an organic light emitting diode; and a plurality of first driving circuits provided in a second area outside the first area, the plurality of first driving circuits being connected to the organic light emitting diodes and configured to drive the organic light emitting diodes to emit light, wherein all of the sub-pixels of a same color in a display segment comprising at least two pixels in the first area are connected to one first driving circuit in the second area outside the first area.

2. The structure according to claim 1, wherein each of the plurality of first driving circuits is connected to one of the organic light emitting diodes correspondingly.

3. The structure according to claim 1, wherein at least one of the plurality of first driving circuits is connected to ones of the organic light emitting diodes correspondingly.

4. The structure according to claim 3, wherein the plurality of first driving circuits comprise three first driving circuits, and an $i^{th}$ first driving circuit of the three first driving circuits is configured to drive the organic light emitting diode in each sub-pixel of an $i^{th}$ color to emit light, $1 \leq i \leq 3$, i being an integer.

5. The structure according to claim 4, wherein each of the plurality of first driving circuits comprises a driving transistor, and each of the organic light emitting diodes comprises a first electrode, a second electrode, and an organic light emitting layer provided between the first electrode and the second electrode;

wherein the driving transistor in the $i^{th}$ first driving circuit is connected to the first electrode in each sub-pixel of the $i^{th}$ color, and the first electrodes of neighboring sub-pixels of the same color are connected.

6. The structure according to claim 1, further comprising:

a control unit connected to the plurality of first driving circuits, the control unit being configured to control the plurality of first driving circuits to drive one or more organic light emitting diodes at one or more pixels of a preset position in the preset pattern to emit light.

7. The structure according to claim 6, wherein the preset pattern comprises a plurality of display segments, and each display segment comprises a plurality of adjacent pixels.

8. The structure according to claim 7, wherein the control unit is configured to control one or more organic light emitting diodes in one or more pixels located in the same display segment to emit or extinguish light simultaneously.

9. The structure according to claim 6, wherein the one or more pixels in the preset position are part of pixels in the preset pattern, or all pixels in the preset pattern.

10. A display panel, comprising:

a display structure comprising:

a plurality of pixels provided in a first area of the display structure, wherein the plurality of pixels are arranged based on a preset pattern, an area of the preset pattern is less than that of the first area, each pixel comprises sub-pixels of three different colors, and each sub-pixel comprises an organic light emitting diode, and a plurality of first driving circuits provided in a second area outside the first area, the plurality of first driving circuits being connected to the organic light emitting diodes and configured to drive the organic light emitting diodes to emit light, wherein all of the sub-pixels of a same color in a display segment comprising at least two pixels in the first area are connected to one first driving circuit in the second area outside the first area;

an effective emitting area, wherein the effective emitting area is provided with a plurality of effective emitting pixels and a plurality of second driving circuits, each effective emitting pixel comprises a plurality of sub-pixels, and the sub-pixels in the effective emitting area are provided to correspond to the second driving circuits one by one.

11. The display panel of claim 10, wherein each of the plurality of first driving circuits is connected to one of the organic light emitting diodes correspondingly.

12. The display panel of claim 10, wherein, at least one of the plurality of first driving circuits is connected to ones of the organic light emitting diodes correspondingly.

13. The display panel of claim 12, wherein the plurality of first driving circuits comprise three first driving circuits, and an $i^{th}$ first driving circuit of the three first driving circuits is configured to drive the organic light emitting diode in each sub-pixel of an $i^{th}$ color to emit light, wherein $1 \leq i \leq 3$, i is an integer.

14. The display panel of claim 13, wherein each of the plurality of first driving circuits comprises a driving transistor, and each of the organic light emitting diodes comprises a first electrode, a second electrode, and an organic light emitting layer provided between the first electrode and the second electrode;

wherein the driving transistor in the $i^{th}$ first driving circuit is connected to the first electrode in each sub-pixel of the $i^{th}$ color; and the first electrodes in neighboring sub-pixels of the same color are connected.

15. The display panel of claim 10, wherein the display structure further comprises:

a control unit connected to the plurality of first driving circuits, the control unit being configured to control the plurality of first driving circuits to drive one or more organic light emitting diodes at one or more pixels of a preset position in the preset pattern to emit light.

16. The display panel of claim 15, wherein the preset pattern comprises a plurality of display segments, and each display segment comprises a plurality of adjacent pixels.

17. The display panel of claim 16, wherein the control unit is configured to control one or more organic light emitting diodes in one or more pixels located in the same display segment to emit or extinguish light simultaneously.

18. The display panel of claim 15, wherein the one or more pixels in the preset position are part of pixels in the preset pattern, or all pixels in the preset pattern.

19. A display device, comprising: a display panel and an image collection device, wherein the display panel comprises: a display structure and an effective emitting area; the display structure comprises: a plurality of pixels provided in a first area of the display structure, wherein the plurality of pixels are arranged based on a preset pattern, an area of the preset pattern is less than that of the first area, each pixel comprises sub-pixels of three different colors, and each sub-pixel comprises an organic light emitting diode, and a plurality of first driving circuits provided in a second area outside the first area, the plurality of first driving circuits being connected to the organic light emitting diodes and configured to drive the organic light emitting diodes to emit light, wherein all of the sub-pixels of a same color in a display segment comprising at least two pixels in the first area are connected to one first driving circuit in the second area outside the first area;

wherein the effective emitting area is provided with a plurality of effective emitting pixels and a plurality of second driving circuits, each effective emitting pixel comprises a plurality of sub-pixels, and the sub-pixels in the effective emitting area are provided to correspond to the second driving circuits one by one; and wherein the image collection device is provided in the first area, and located on a side of the display structure away from a light emitting direction.

20. The device according to claim 19, further comprising:

a sensor provided in the first area, the sensor being located on the side of the display structure away from the light emitting direction.

* * * * *